United States Patent [19]

Riblet et al.

[11] Patent Number: 4,670,724

[45] Date of Patent: Jun. 2, 1987

[54] STUB-SUPPORTED TRANSMISSION LINE DEVICE

[75] Inventors: Gordon P. Riblet, Wellesley; Ronald A. Wilson, Medway, both of Mass.

[73] Assignee: Microwave Development Laboratories, Inc., Natick, Mass.

[21] Appl. No.: 757,465

[22] Filed: Jul. 22, 1985

[51] Int. Cl.[4] ..... H01D 3/06

[52] U.S. Cl. ..... 333/244; 174/28; 333/123

[58] Field of Search ..... 333/244, 243, 123; 174/28

[56] References Cited

U.S. PATENT DOCUMENTS

| | | | |
|---|---|---|---|
| 1,939,053 | 12/1933 | Hunt | 333/202 |
| 2,751,557 | 6/1956 | Sosin | 333/206 |
| 3,524,190 | 8/1970 | Killion et al. | 333/243 X |
| 3,863,181 | 1/1975 | Glance et al. | 333/243 |

OTHER PUBLICATIONS

Ragan, George L., *Microwave Transmission Circuits;* MIT Radiation Lab Series, vol. 9; pub. 1948; pp. 180–182.

Sandeman, E. K., "Transmission Line Filter"; *Wireless Engineering;* Jan. 1949, pp. 11–14.

*Primary Examiner*—Eugene R. LaRoche
*Assistant Examiner*—Benny T. Lee
*Attorney, Agent, or Firm*—Wolf, Greenfield & Sacks

[57] ABSTRACT

A stub-support arrangement for a coaxial transmission line wherein the line has inner and outer conductors and the stub is in the form f oppositely disposed stubs each having a length of $\frac{1}{8}$ wavelength at the center operating frequency or less. One of the stubs is an open-circuit stub and the other is a short-circuit stub. In the case of the stubs being of $\frac{1}{8}$ wavelength, the characteristic admittances of the stubs are equal and in the case of the stubs being less than $\frac{1}{8}$ wavelength the characteristic admittance of the open-circuit stub becomes larger and that of the short-circuit stub becomes smaller as the physical length of the stub is reduced.

6 Claims, 9 Drawing Figures

STUB-SUPPORTED TRANSMISSION LINE DEVICE

BACKGROUND OF THE INVENTION

The present invention relates in general to an improved form of stub-support for a coaxial radio frequency transmission line. More particularly, the invention pertains to an improved stub-support for coaxial radio frequency transmission lines in which he support is more compact and has improved stiffness of support.

The use of quarter wavelength stubs for the support of the inner conductor with respect to the outer conductor of a coaxial line is known in the art. See, for example, U.S. Pat. No. 2,446,982 to Pound and U.S. Pat. No. 2,582,604 also to Pound. Both of these patents show how the bandwidth of such stub-supports is substantially increased by suitably lowering the impedance of the coaxial line for a quarter of a wavelength on either side of the stub-support. In this connection also refer to "Quarter-Wave Compensation of Resonant Discontinuities," by C. E. Muehe, IRE Transactions on Microwave Theory and Techniques (Correspondence), Vol. MTT-7, pp. 296–297; April 1959., and "The Application of a New Class of Equal-Ripple Functions to Some Familiar Transmission-Line Problems" by H. J. Riblet, Transactions of IEEE, Vol. MTT-12, pp. 415–421, July, 1964. These articles disclose closed expressions for the relationship between impedance of the coaxial line and the impedance of the stub for optimum performance as a function of the desired bandwidth. The prior theoretical treatment of this issue, however, has neglected the residual susceptances which are present at the junction of the stub and the coaxial line, perhaps because they are small in the round coaxial structures that have been considered heretofor such as found in U.S. Pat. No. 2,446,982 or U.S. Pat. No. 2,582,604, both to Pound.

Also described herein in FIG. 1 is a prior art structure in the form of a stub-support for a coaxial radio frequency transmission line having improved performance obtained by altering the dimensions of the outer conductor rather than altering the dimensions of the inner conductor. The improved performance is obtained by decreasing the dimensions of the outer conductor. In this regard, refer to FIG. 1 which is a sectioned perspective view of a compensated stub support. In FIG. 1 the coaxial radio frequency transmission line comprises an inner conductor and an outer conductor. The outer conductor comprises a pair of recessed channel members 1 and 2 while the inner conductor comprises a conductor member 3 which is of solid square cross-section. The inner conductor is supported within the generally square outer conductor by means of stub-supports which comprise oppositely-disposed inner conductors 4, outer conductors 5, and associated end walls 7. FIG. 1 also shows the transformer step 6 at the outer conductor. The electrical length of the stub-supports is, as depicted in FIG. 1, approximately $\frac{1}{4}$ of a wavelength long at the middle of the useful operating frequency band of the coaxial structure. The shunt admittance of the stubs, as presented to the coaxial line, is zero at mid-band so that the stubs are essentially invisible to an RF signal traveling in the coaxial line.

In the prior art structure of FIG. 1 as well as in the structures described in the aforementioned Pound patents, the stub-supports are relatively large and cumbersome and provide support that is subject to a certain lack of stiffness or rigidity.

Accordingly, it is an object of the present invention to provide stub-support for a transmission line or the like device in which the stub-support is more compact.

Another object of the present invention is to provide an improved coaxial radio frequency transmission line in which the stub-support thereof is not only compact but also provides for improved stiffness of support for the coaxial line.

Still another object of the present invention is to provide a stub-supported transmission line device which is more compact and which thus enables the ready construction of more compact devices such as a coaxial hybrid device.

SUMMARY OF THE INVENTION

With the above and other objects in view, the present invention comprises the combination and arrangement of parts hereinafter more fully described, illustrated in the accompanying drawing, and more particularly pointed out in the appended claims, it being understood that changes may be made in the form, size, proportions and minor details of construction without departing from the specifics of or sacrificing any of the advantages of the invention. More particularly, in accordance with the invention there is provided a coaxial line having an inner conductor which in the preferred embodiment is of rectangular cross-section and supported with respect to the outer conductor of the coaxial line by means of a pair of oppositely-disposed stubs. In one embodiment in accordance with the present invention the pair of stubs comprise an open circuit stub on one side and a short circuit stub on the other side each of approximately $\frac{1}{8}$ of a wavelength long. In accordance with another embodiment of the invention derived herein, characteristic admittances of the stubs may be selected as a function of the electrical stub length. In this connection the characteristic admittance of the open-circuited stub becomes larger and that of the short-circuited stub becomes smaller as the electrical length of the stub is reduced. Also, in accordance with the invention the reduced length open circuit-short circuit stub construction provides, from a mechanical standpoint, a stub-support arrangement that has improved stiffness.

BRIEF DESCRIPTION OF THE DRAWINGS

Numerous other objects, features and advantages of the invention will now become apparent upon a reading of the following detailed description taken in conjunction with the accompanying drawings, in which.

DETAILED DESCRIPTION

Figure 1:
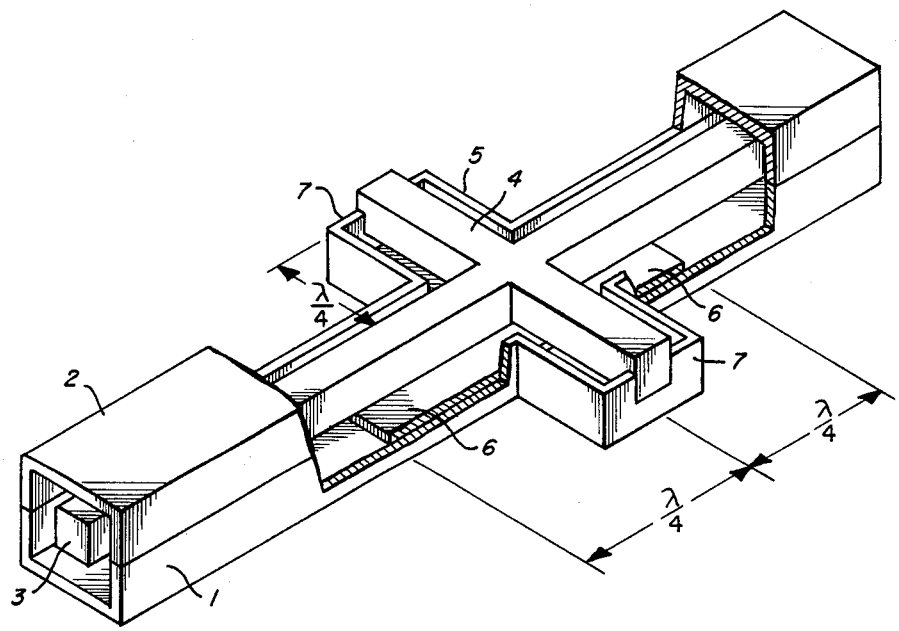
PRIOR ART Fig. 1
FIG. 1 is a sectioned perspective view of a prior art form of stub-support for a coaxial transmission line showing quarter wavelength stub-supports.

Reference has been made hereinbefore to the prior art drawing of FIG. 1 which illustrates a coaxial radio frequency transmission line comprised of inner and outer conductors with the inner conductor being supported from the outer conductor by means of stub supports in the form of oppositely-disposed inner conductors 4, outer conductors 5 and associated end walls 7. The electrical length of the stub-supports in FIG. 1 is $\frac{1}{4}$ of a wavelength long at the middle of the useful operating frequency band of the coaxial structure.

Figure 2:
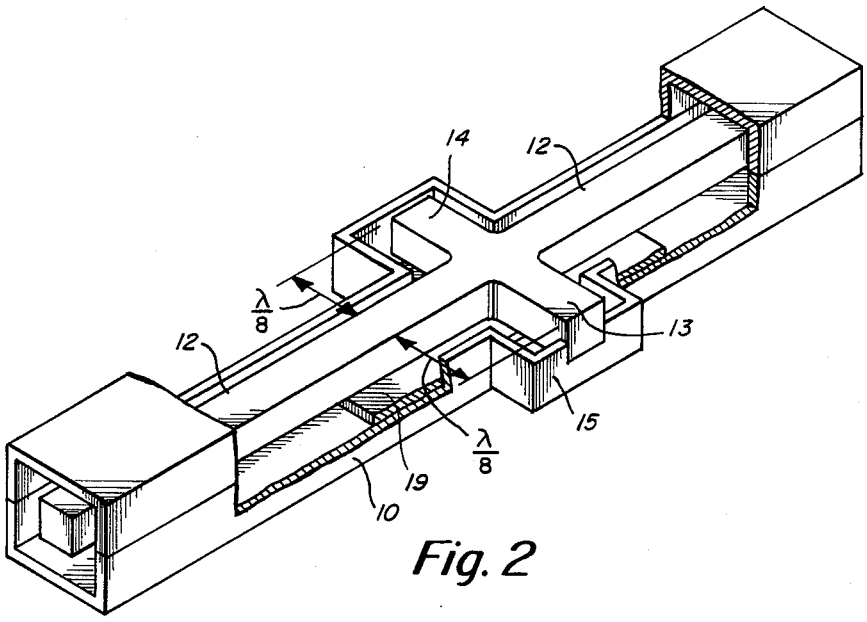
FIG. 2 is a sectioned perspective view of a stub-supported coaxial transmission line in accordance with the present invention employing oppositely disposed open-circuit and short-circuit stubs of $\frac{1}{8}$ wavelength or shorter.

FIG. 2 also shows a coaxial radio frequency transmission line in which the stub supports are more compact and are of $\frac{1}{8}$ wavelength. Hereinafter, derivations are set forth illustrating, in other alternate embodiments, versions in which the stub-support is made even more compact having lengths less than $\frac{1}{8}$ wavelength at mid-band. The sectioned perspective view of FIG. 2 illustrates the $\frac{1}{8}$ wavelength version.

With reference to FIG. 2 it is noted that there is an outer conductor 10 and an inner conductor 12. The inner conductor 12 has associated therewith oppositely-disposed stubs including inner conductor stubs 13 and 14. The stub 14 is an open circuit stub and thus terminates in an open circuit manner. The other stub 13 is a short circuit stub and thus terminates at the stub outer conductor wall 15. In connection with the embodiment illustrated in FIG. 2, there may also be provided a transformer step 19 extending symmetrically on either side of the stubs 13 and 14.

Equations are now derived in connection with the open-circuit and short-circuit stub construction in which both stubs are of $\frac{1}{8}$ wavelength at mid-band. Thereafter, derivatives are set forth in connection with the use of open-circuit and short-circuit stubs where both stubs have a length less than $\frac{1}{8}$ wavelength at mid-band resulting in an even more compact stub support.

For the $\frac{1}{8}$ wavelength stub-support version of the present invention it can be assumed that Y=characteristic admittance of the stub and $\theta$=electrical length of the stub. Starting with the susceptance of a $\frac{1}{4}$ wavelength short-circuit stub, as in FIG. 1, this may be expressed by the following equation:

$$B=2Y\cot 2\theta \tag{1}$$

The above equation (1) may also be written in the following manner:

$$B=\frac{2Y[(\cot^2\theta-1)]}{2\cot\theta}=Y\cot\theta-\frac{Y}{\cot\theta} \tag{2}$$

$$B=Y\cot\theta-Y\tan\theta$$

It is noted that where the expression 2Y cot $2\theta$ is for a $\frac{1}{4}$ wavelength stub, as in FIG. 1, thus the expression Y cot $\theta$−Y tan $\theta$ is an expression indicating two stubs each of half the $\frac{1}{4}$ wavelength or in other words, $\frac{1}{8}$ wavelength long with the expression Y cot $\theta$ indicating a $\frac{1}{8}$ wavelength short-circuit stub and the expression −Y tan $\theta$ referring to a $\frac{1}{8}$ wavelength open-circuit stub, both of these stubs being essentially in parallel as in FIG. 2.

Thus, by the above derivation it can be seen that basically the same type of stub support previously accomplished with a $\frac{1}{4}$ wavelength stub can now be accomplished with $\frac{1}{8}$ wavelength stubs, one an open-circuit stub and the other a short-circuit stub with no change in electrical performance.

Now, for the version of the invention in which both stubs have a length less than $\frac{1}{8}$ wavelength the characteristic admittances of the two stubs are thus unequal. In this regard, reference may also be made to FIG. 3A which shows the version of stubs of $\frac{1}{8}$ wavelength. This can be compared to the version in FIG. 4A of less than $\frac{1}{8}$ wavelength with the stub-support notedly being more compact, although, there are variations in characteristic admittance as noted by the comparison of dimensions between FIGS. 3A and 4A.

In the following derivations;

$Y_0$=susceptance of open-circuit stub, $Y_S$=susceptance of short-circuit stub, $Y_1$=characteristic admittance of open-circuit stub, $Y_2$=characteristic admittance of short-circuit stub, $\theta_1$=electrical length of the open-circuit stub, $\theta_2$=electrical length of the short-circuit stub, $l_1$=physical length of the open-circuit stub, $l_2$=physical length of the short-circuit stub.

The total susceptance introduced by the stub pair is given by the following equation:

$$B=Y_1\tan\theta_1-Y_2\cot\theta_2 \tag{3}$$

The susceptance B, set forth in equation (3) should approximate the susceptance, Y tan $\theta$−Y cot $\theta$=−2Y cot $2\theta$ of a $\frac{1}{8}$ wavelength stub combination with values of $\theta_1$, $\theta_2$ chosen to be less than 45°.

In the spirit of a Taylor series expansion this is the case if $B(\omega)|\omega=\omega_m=0$ at the mid band frequency $\omega=\omega_m$ (since −2Y cot $2\theta$=0 at mid-band) and the frequency derivative at mid-band $$\frac{dB}{d\omega}\bigg|\omega=\omega_m$$

is that for the $\frac{1}{8}$ wavelength stub combination. This yields two equations which may be used to determine $Y_1$, $Y_2$, if $\theta_1$, $\theta_2$ are less than 45° and are specified. One condition on the stubs is that B=0 in equation (3). By so doing, there is thus derived the following equation:

$$Y_1/Y_2=\frac{\mathrm{COT}\,\theta_2}{\mathrm{TAN}\,\theta_1}=\frac{\cos\theta_1\cos\theta_2}{\sin\theta_1\sin\theta_2}. \tag{4}$$

Equation (4) determines the ratio of the stub characteristic admittances for given stub electrical lengths $\theta_1$, $\theta_2$, respectively. The other condition for short stubs is that the sum of the susceptance slope parameters for both stubs is to be a fixed constant. This second equation, which results from equating the first derivatives at mid-band, is as follows:

$$\frac{4l^*}{C} Y = \frac{l_1}{C} \frac{Y_1}{\cos^2 \theta_1} + \frac{l_2 Y_2}{C \sin^2 \theta_2} \quad (5)$$

where l*, Y, and C are the physical length, stub characteristic admittances for the corresponding ⅛ wavelength stubs and the speed of light, respectively. It can further be assumed that both stubs have the same electrical length $\theta^*$ and thus the same physical length l*. Making this further assumption simplifies the equation to give simple closed form expressions for $Y_1$ and $Y_2$. These expressions are now shown in the following equation (6):

$$Y_1 = 2Y\left(\frac{45°}{\theta^*}\right) \cos^2\theta^*, \; Y_2 = 2Y\left(\frac{45°}{\theta^*}\right) \sin^2\theta^*. \quad (6)$$

For example, if Y=1 and $\theta^*=30°$ (1/12 wavelength long stubs), then $Y_1=2.25$ and $Y_2=0.75$. In another example where the electrical length $\theta^*=22.5°$ (1/16 wavelength long stubs), then $Y_1=3.414$ and $Y_2=0.5859$. From these derivations it can be clearly seen that the characteristic admittance of the open-circuited stub becomes larger and that of the short-circuited stub becomes smaller as the physical length of the stubs is reduced.

Figure 3A:
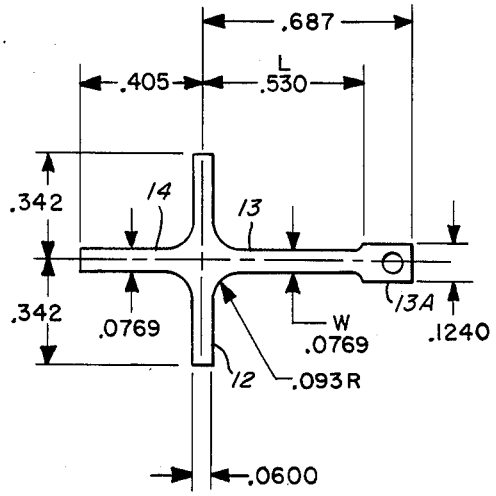
FIG. 3A is a plan view showing the stub-support for an electrical length of 45°.
Figure 3B:
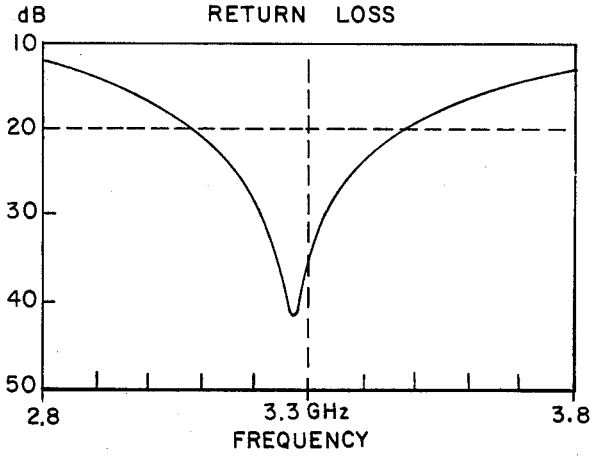
FIG. 3B is a plot of return loss versus frequency for the stub-support of FIG. 3A.

Reference is now made to FIG. 3A and the associated return loss plot of FIG. 3B. In FIG. 3A there is shown a plan view illustrating the center conductor 12 along with the stubs 13 and 14. The stub 14 is an open-circuit stub and the stub 13 is a short-circuit stub shorted at 13A. In FIG. 3A the stubs are of approximate ⅛ wavelength ($\theta=45°$). It is noted that the characteristic admittances are equal for each stub.

Figure 4A:
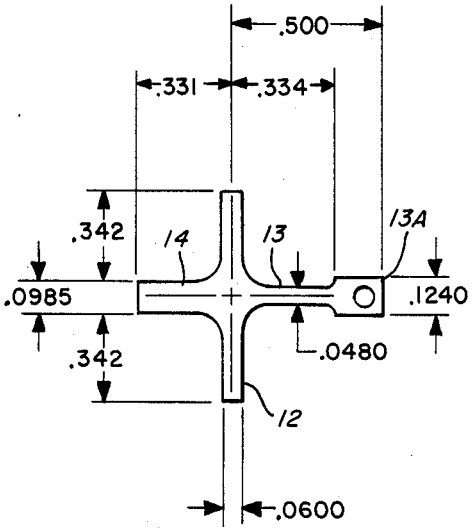
FIG. 4A is a plan view showing the stub-support for an electrical length of 30°.

FIG. 4 illustrates an electrical length of 30° which makes for shorter stubs corresponding to 1/12 wavelength long. The characteristic admittances of the two stubs are now unequal. In this regard, note in FIG. 4A the open-circuit stub 14 has a width of 0.0985 while the short-circuit stub has a width of 0.0480. Thus, clearly the characteristic admittance of the open-circuited stub becomes larger and that of the short-circuited stub becomes smaller as the physical length of the stubs is reduced.

Figure 4B:
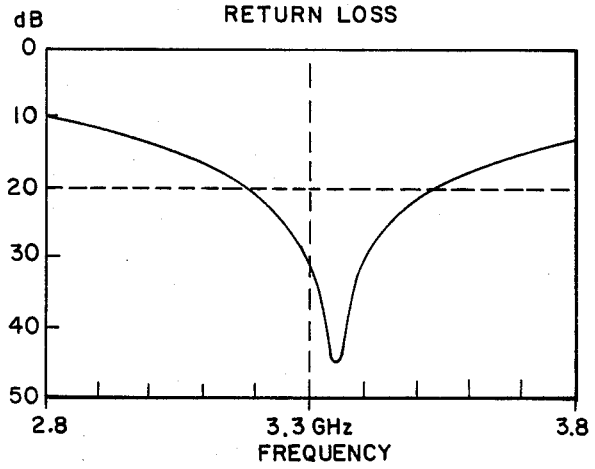
FIG. 4B is a plot of return loss versus frequency for the stub-support of FIG. 4A.

In connection with FIGS. 3B and 4B reference is now made to the following two tables I and II. These tables illustrate specific values for return loss versus frequency.

TABLE I

| Frequency Return Loss | |
|---|---|
| GHz | dB |
| 45° | |
| 3.000 | 16.92 |
| 3.020 | 17.58 |
| 3.040 | 18.27 |
| 3.060 | 19.04 |
| 3.080 | 19.86 |
| 3.100 | 20.84 |
| 3.120 | 21.97 |
| 3.140 | 23.24 |
| 3.160 | 24.60 |
| 3.180 | 26.18 |
| 3.200 | 28.36 |
| 3.220 | 30.98 |
| 3.240 | 34.75 |
| 3.260 | 40.74 |
| 3.280 | 41.68 |
| 3.300 | 35.44 |

TABLE I-continued

| Frequency Return Loss | |
|---|---|
| GHz | dB |
| 45° | |
| 3.300 | MARKER F0 |
| 3.320 | 31.44 |
| 3.340 | 28.72 |
| 3.360 | 26.57 |
| 3.380 | 24.98 |
| 3.400 | 23.72 |
| 3.420 | 22.52 |
| 3.440 | 21.47 |
| 3.460 | 20.52 |
| 3.480 | 19.66 |
| 3.500 | 18.95 |
| 3.520 | 18.31 |
| 3.540 | 17.71 |
| 3.560 | 17.17 |
| 3.580 | 16.64 |
| 3.600 | 16.11 |

TABLE II

| Frequency Return Loss | |
|---|---|
| GHz | dB |
| 30° | |
| 3.000 | 13.55 |
| 3.020 | 14.06 |
| 3.040 | 14.63 |
| 3.060 | 15.22 |
| 3.080 | 15.83 |
| 3.100 | 16.57 |
| 3.120 | 17.24 |
| 3.140 | 18.06 |
| 3.160 | 18.91 |
| 3.180 | 19.86 |
| 3.200 | 20.99 |
| 3.220 | 22.27 |
| 3.240 | 23.74 |
| 3.260 | 25.42 |
| 3.280 | 27.57 |
| 3.300 | 30.70 |
| 3.300 | MARKER F0 |
| 3.320 | 35.49 |
| 3.340 | 45.13 |
| 3.360 | 44.60 |
| 3.380 | 34.74 |
| 3.400 | 30.52 |
| 3.420 | 27.56 |
| 3.440 | 25.48 |
| 3.460 | 23.90 |
| 3.480 | 22.52 |
| 3.500 | 21.36 |
| 3.520 | 20.27 |
| 3.540 | 19.37 |
| 3.560 | 18.56 |
| 3.580 | 17.87 |
| 3.600 | 17.19 |

Figure 5:
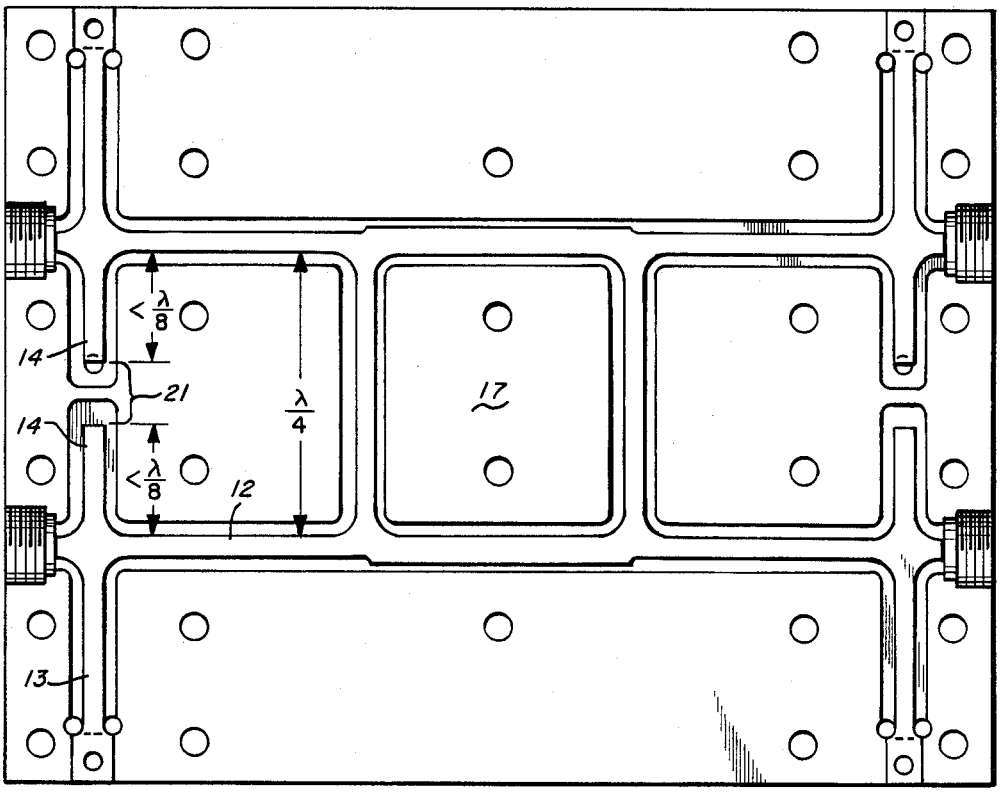
FIG. 5 is a plan view illustrating the stub-support in accordance with the present invention as employed in constructing a coaxial hybrid.

Reference is also now made to FIG. 5 which is a plan view illustrating the stub-support of the present invention as employed in constructing a coaxial hybrid. It is noted that because of the possibility of reducing the stub-supports to less than ⅛ wavelength, one can employ the stub supports of the matched two branch hybrids without having the stubs intersect or interfere with each other as indicated by the gap 21 between the stubs in FIG. 5. In this regard, in FIG. 5 note the center conductor 12 with the associated stubs including the short-circuit stub 13 and the open-circuit stub 14. The conductor 12 couples to the hybrid 17. In the particular embodiment of FIG. 5 there are four conductors associated with the hybrid, of course, and thus there are four pairs of stub-supports as noted.

Figure 6:
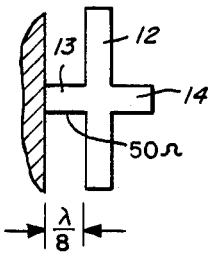
FIG. 6 is a schematic plan view illustrating the $\frac{1}{8}$ wavelength stub-support of the invention, which diagram is used in calculating stiffness particularly as compares with prior art structures.
Figure 7:
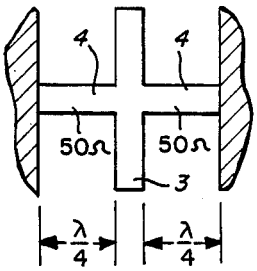
Fig. 7 PRIOR ART
FIG. 7 is a schematic plan view of a prior art stub-support employing oppositely-disposed $\frac{1}{4}$ wavelength supports.

Reference has also been made hereinbefore to a characteristic of the improved stub-support of the present invention particularly in comparison with the stub support such as illustrated in FIG. 1 of the present application in that prior art construction. In this regard, reference is made in the schematic diagram of FIG. 6 to the version of the present invention employing $\frac{1}{8}$ wavelength open and short-circuit stubs as illustrated in FIG. 6. Reference is also made to FIG. 7 which schematically represents the stub-support per the embodiment of the prior art illustrated in FIG. 1 herein. In both FIGS. 6 and 7 the short circuit stubs are illustrated by rigid attachment to what is considered to be a fixed wall. In FIG. 6 this attachment is to a single wall at one stub and at FIG. 7 attachment is at both stubs.

To determine the relative stiffness of alternate support arrangements for stub supported coaxial lines, the deflection formula for a cantilevered beam is used. This formula is as follows:

$$D = \frac{WL^3}{3EI} \tag{7}$$

In the above equation (7), W=load, L=length of stub, E=modulus of elasticity, and I=moment of inertia.

To compare the deflection of FIG. 6 with the deflection of FIG. 7, one can divide the deflection of the conductor assembly in FIG. 2 by the deflection of the conductor assembly in FIG. 1. Because the part in FIG. 7 is supported by two stubs, one can divide the deflection by 2. Therefore, equation (7) may be used to derive the following stiffness comparison formula;

$$\frac{[W_2 L_2^3]}{3E_2 I_2} \div 2 \div \frac{W_1 L_1^3}{3E_1 I_1} = \text{Stiffness Comparison} \tag{8}$$

Items that are the same in both expressions of equation (8) are W, E, and I. Therefore, equation (8) may be reduced to the following:

$$\text{Stiffness Comparison} = (L_2^3 \div 2) \div L_1^3$$

Because $L_2 = 2 \times L_1$, substitute ($2 \times L_1$ for $L_2$).

Therefore, $[(2L_1)^3 \div 2] \div L_1^3$=stiffness comparison; 4=stiffness comparison.

Therefore, from the above derivation it can be seen that the support in FIG. 2 is four times as stiff as the support provided in FIG. 1. This is due primarily to the parameter in the formula in which the deflection is a function of the length cubed. Therefore, even though there is support on either side with regard to the support of FIG. 7, because the length is $\frac{1}{2}$ in the version of FIG. 6 this essentially means that the stiffness is 4 times greater in the embodiment of FIG. 6 than in the embodiment of FIG. 7.

Having now described a limited number of embodiments of the present invention, it should now be apparent to those skilled in the art that numerous other embodiments and modifications thereof are contemplated as falling within the scope of the present invention as defined by the appended claims.

What is claimed is:

1. A coaxial transmission line having an outer conductor and an inner conductor coaxially disposed with respect to the outer conductor, conductive stub means disposed at a predetermined position along the coaxial transmission line for providing support of the inner conductor in the outer conductor, said stub means comprising a pair of oppositely directed stubs each having a length of less than $\frac{1}{8}$ wavelength at the center operating frequency with the characteristic admittances of the respective stubs being unequal, said oppositely directed stubs including a short-circuit stub on one side and an open-circuit stub on the other side, said short-circuit stub including a stub inner conductor and a stub outer conductor, said stub inner conductor being connected at one end to the inner conductor of the coaxial line and being electrically short circuited to said stub outer conductor at another end so as to support said stub inner conductor and in turn support said coaxial transmission line inner conductor.

2. A coaxial transmission line as set forth in claim 1 wherein said outer conductor of the transmission line has at said predetermined position a transformer means having a lower impedance than that of the coaxial line.

3. A coaxial transmission line as set forth in claim 2 wherein said transformer means is formed by providing a step reduction in the inner diameter of the outer conductor.

4. A coaxial transmission line as set forth in claim 1 wherein said outer conductor comprises a pair of channel sections.

5. A coaxial transmission line as set forth in claim 1 wherein the relationship between the characteristic admittances of the stubs and the electrical length is given by the following formulas: $Y_1 = 2Y(45°/\theta^*) \cos^2 \theta^*$, $Y_2 = 2Y(45°/\theta^*) \sin^2 \theta^*$, where $Y_1$=characteristic admittance of the open-circuit stub, $Y_2$=characteristic admittance of the short-circuit stub, Y=a constant and $\theta^*$=stub electrical length.

6. A coaxial transmission line as set forth in claim 1 wherein the characteristic admittance of the open-circuited stub has a larger magnitude than the characteristic admittance of the short-circuited stub.

* * * * *